US010002725B2

(12) United States Patent
Chao

(10) Patent No.: US 10,002,725 B2
(45) Date of Patent: Jun. 19, 2018

(54) KEYSWITCH

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Ling-Hsi Chao, Taoyuan (TW)

(73) Assignees: DARFON ELECTRONICS (SUZHOU) CO., LTD., Suzhou, Jiangsu Province (CN); DARFON ELECTRONICS CORP., Taoyuan (TW)

( * ) Notice: Subject to any disclaimer, the term of this patent is extended or adjusted under 35 U.S.C. 154(b) by 0 days. days.

(21) Appl. No.: 15/390,748

(22) Filed: Dec. 27, 2016

(65) Prior Publication Data

US 2017/0243707 A1 Aug. 24, 2017

(30) Foreign Application Priority Data

Feb. 24, 2016 (TW) ..... 105105357 A

(51) Int. Cl.
*H01H 13/70* (2006.01)
*H01H 13/52* (2006.01)
*H01H 13/14* (2006.01)

(52) U.S. Cl.
CPC ..... *H01H 13/52* (2013.01); *H01H 13/14* (2013.01)

(58) Field of Classification Search
CPC .... H01H 13/52; H01H 13/14; H01H 13/7065; H01H 3/125
USPC ..... 200/344, 345, 5 A
See application file for complete search history.

(56) References Cited

U.S. PATENT DOCUMENTS 6,375,372 B1 * 4/2002 Tsau ..... H01H 3/125 200/345
6,572,289 B2 * 6/2003 Lo ..... H01H 3/125 400/491.2
2006/0000694 A1 1/2006 Nishino
2013/0334019 A1 12/2013 Lan

FOREIGN PATENT DOCUMENTS

CN 201853597 U 6/2011
CN 202930282 U 5/2013

* cited by examiner

*Primary Examiner* — Edwin A. Leon
*Assistant Examiner* — Lheiren Mae A Caroc
(74) *Attorney, Agent, or Firm* — Winston Hsu

(57) ABSTRACT

A keyswitch includes a board, a cap, and a support device. The board has first and second bending members and a main body extending along X and Y axes perpendicular to each other. An included angle between a first abutting surface of the first bending member and the X-axis and an included angle between a second abutting surface of the second bending member and the X-axis are greater than 0°. The support device includes first and second support members having first and second hook structures respectively. When the cap is pressed, the first and second hook structures slide on the first and second abutting surfaces respectively to deform the first and second hook structures. When the cap is released, the deformed first and second hook structures drive the first and second support members to slide relatively for making the cap return to a non-pressed position.

16 Claims, 8 Drawing Sheets

KEYSWITCH

BACKGROUND OF THE INVENTION

1. Field of the Invention

The present invention relates to a keyswitch, and more specifically, to a keyswitch utilizing a hook structure on a support member to abut against a bending member formed obliquely on a board to provide an elastic force for moving a cap back to its original position.

2. Description of the Prior Art

A keyboard, which is the most common input device, can be found in variety of electronic apparatuses for users to input characters, symbols, numerals and so on. Furthermore, consumer electronic products and industrial machine tools are all equipped with a keyboard for performing input operations.

Please refer to FIG. 1, which is a cross-sectional diagram of a keyswitch 1 according to the prior art. As shown in FIG. 1, the keyswitch 1 includes a board 10, a cap 12, a circuit board 14, a support device 16, and an elastic member 18. The circuit board 14 is disposed on the board 10. The support device 16 is disposed between the cap 12 and the board 10 for supporting the cap 12. The elastic member 18 is also disposed between the cap 12 and the board 10. Accordingly, when the cap 12 is pressed by a user, a triggering portion 19 of the elastic member 18 triggers a switch 15 on the circuit board 14 for performing a corresponding input function.

However, since disposal of the elastic member 18 requires more space to further increase the overall height of the keyswitch 1, it is disadvantageous to the thinning design of the keyswitch 1.

SUMMARY OF THE INVENTION

The present invention provides a keyswitch. The keyswitch includes a board, a cap, and a support device. The board has a main body, at least one first bending member, and at least one second bending member. The main body extends along a plane containing an X-axis and a Y-axis. The X-axis and the Y-axis are perpendicular to each other. The at least one first bending member has a first abutting surface. The at least one second bending member has a second abutting surface. An included angle between the X-axis and the first abutting surface is larger than 0°. An included angle between the X-axis and the second abutting surface is larger than 0°. The cap is disposed above the board. The support device is disposed between the board and the cap. The support device includes a first support member and a second support member. The first support member and the second support member are movably connected to the cap and the board. A first hook structure is formed on the first support member. A second hook structure is formed on the second support member. When the cap is not pressed, the first hook structure abuts against the first abutting surface and the second hook structure abuts against the second abutting surface to keep the cap at a non-pressed position. When the cap is pressed by an external force, the first hook structure slides on the first abutting surface to increase an amount of elastic deformation of at least one of the first hook structure and the at least one first bending member, and the second hook structure slides on the second abutting surface to increase an amount of elastic deformation of at least one of the second hook structure and the at least one second bending member. When the external force is released, the at least one of the first hook structure and the at least one first bending member provides a first elastic force to drive the first support member to slide, and the at least one of the second hook structure and the at least one second bending member provides a second elastic force to drive the second support member to slide to make the cap move back to the non-pressed position.

The present invention further provides a keyswitch. The keyswitch includes a board, a cap, and a support device. The board has a main body, at least one first bending member, and at least one second bending member. The main body extends along a plane containing an X-axis and a Y-axis. The X-axis and the Y-axis are perpendicular to each other. The at least one first bending member has a first abutting surface. The at least one second bending member has a second abutting surface. An included angle between the X-axis and the first abutting surface is larger than 0°. An included angle between the X-axis and the second abutting surface is larger than 0°. The cap is disposed above the board. The support device is disposed between the board and the cap. The support device includes a first support member and a second support member. The first support member and the second support member are movably connected to the cap and the board. A first hook structure is formed at a first side of the first support member. A second hook structure is formed on a second side of the second support member. The first side of the first support member is movable along a first movement path relative to the board. The second side of the second support member is movable along a second movement path relative to the board. The first movement path and the second movement path are parallel to the X-axis. The first abutting surface has a first relatively far region and a first relatively close region. A distance between the first relatively close region and the first movement path is less than a distance between the first relatively far region and the first movement path. The second abutting surface has a second relatively far region and a second relatively close region. A distance between the second relatively close region and the second movement path is less than a distance between the second relatively far region and the second movement path. When the cap is not pressed, the first hook structure abuts against the first relatively far region and the second hook structure abuts against the second relatively far region to keep the cap at a non-pressed position. When the cap is pressed by an external force, the first hook structure slides to the first relatively close region along the first abutting surface to increase an amount of elastic deformation of at least one of the first hook structure and the at least one first bending member, and the second hook structure slides to the second relatively close region along the second abutting surface to increase an amount of elastic deformation of at least one of the second hook structure and the at least one second bending member. When the external force is released, the at least one of the first hook structure and the at least one first bending member provides a first elastic force to drive the first support member to slide for making the first hook structure move back to abut against the first relatively far region, and the at least one of the second hook structure and the at least one second bending member provides a second elastic force to drive the second support member to slide for making the second hook structure move back to abut against the second relatively far region to make the cap move back to the non-pressed position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
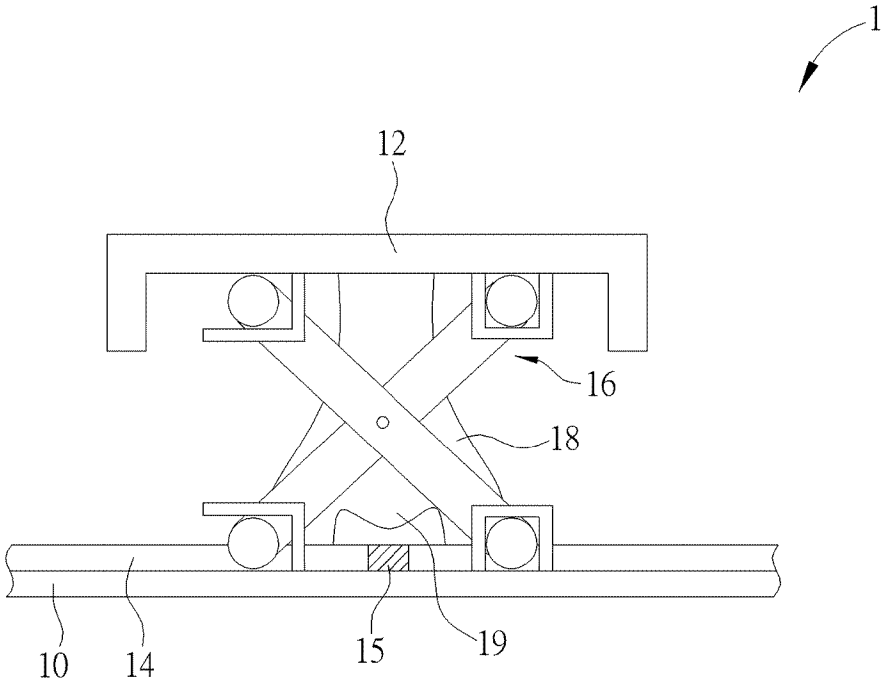
FIG. 1 PRIOR ART
FIG. 1 is a cross-sectional diagram of a keyswitch according to the prior art.
Figure 2:
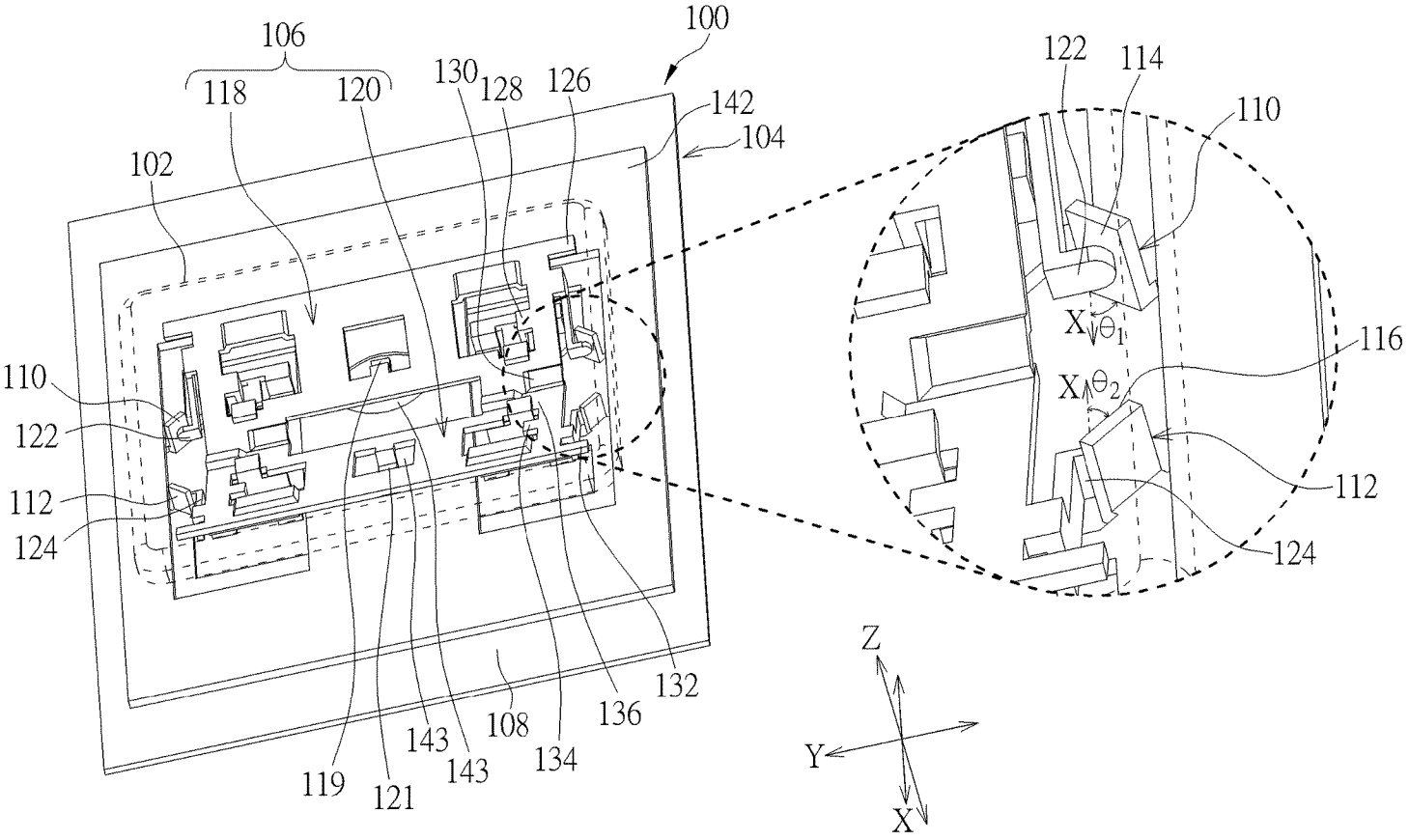
FIG. 2 is an enlarged diagram of a keyswitch according to an embodiment of the present invention.

Please refer to FIG. 2, which is an enlarged diagram of a keyswitch 100 according to an embodiment of the present invention. For clearly showing the internal structural design of the keyswitch 100, a cap 102 is briefly depicted by dotted lines in FIG. 2. The keyswitch 100 can be a thinning keyswitch for a user to press to execute an input function, but not limited thereto. As shown in FIG. 2, the keyswitch 100 includes the cap 102, a board 104, and a support device 106. The cap 102 is disposed above the board 104. The board 104 has a main body 108, at least one first bending member 110 (two shown in FIG. 2, but not limited thereto), and at least one second bending member 112 (two shown in FIG. 2, but not limited thereto). The main body 108 extends along a plane containing an X-axis and a Y-axis as shown in FIG. 2. The X-axis and the Y-axis are perpendicular to each other. The first bending member 110 has a first abutting surface 114. The second bending member 112 has a second abutting surface 116. An included angle $\theta_1$ between the X-axis and the first abutting surface 114 is larger than 0% and an included angle $\theta_2$ between the X-axis and the second abutting surface 116 is larger than 0°. The aforesaid included angles can be varied according to the practical application of the present invention for adjusting the practical pressing feedback of the keyswitch 100.

As shown in FIG. 2, the support device 106 is disposed between the cap 102 and the board 104. The support device 106 includes a first support member 118 and a second support member 120. The first support member 118 and the second support member 120 are movably connected to the cap 102 and the board 104 to make the cap 102 movable between a non-pressed position and a pressed position with rotation of the first support member 118 and the second support member 120. A first hook structure 122 is formed on the first support member 118, and a second hook structure 124 is formed on the second support member 120. In this embodiment, the first hook structure 122 can preferably be a first elastic hook arm extending from a side of the first support member 118 toward the first bending member 110, and the second hook structure 124 can preferably be a second elastic hook arm extending from a side of the second support member 120 toward the second bending member 112. The length of the aforesaid hook arms can be varied according to the practical application of the keyswitch 100 for adjusting the practical pressing feedback of the keyswitch 100.

Figure 3:
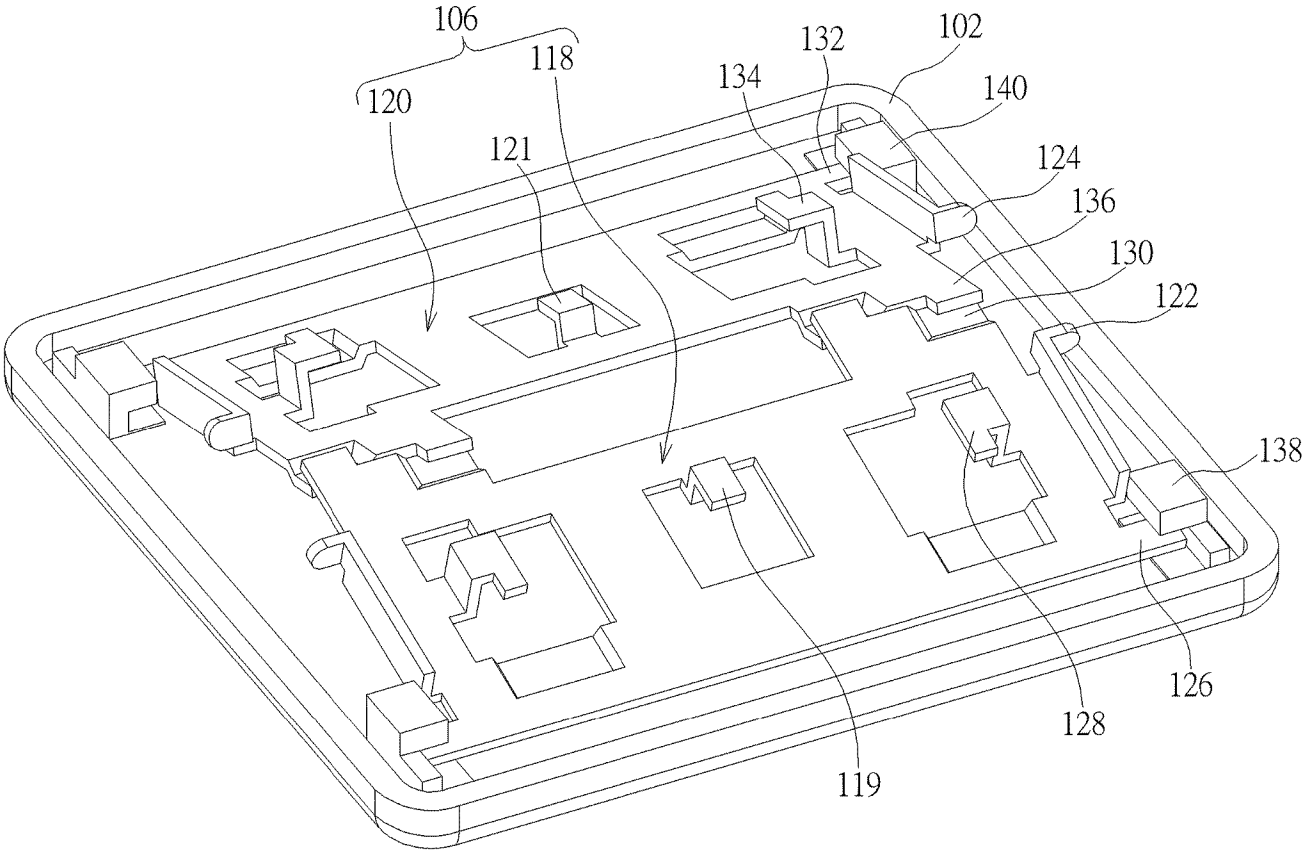
FIG. 3 is an assembly diagram of a cap and a support device in FIG. 2.

In practical application, please refer to FIG. 2 and FIG. 3. FIG. 3 is an assembly diagram of the cap 102 and the support device 106 in FIG. 2. As shown in FIG. 2 and FIG. 3, the first support member 118 can have a first connection portion 126, a second connection portion 128, and a first linkage portion 130, and the second support member 120 can have a third connection portion 132, a fourth connection portion 134, and a second linkage portion 136. The first connection portion 126 and the third connection portion 132 are movably connected to the cap 102 and the second connection portion 128 and the fourth connection portion 134 are movably connected to the board 104 to make the cap 102 movable upward and downward relative to the board 104. The first linkage portion 130 and the second linkage portion 136 can be movably joined with each other to make the first support member 118 and the second connection member 120 move together when the cap 102 is pressed by an external force or the external force is released. As shown in FIG. 3, the first linkage portion 130 and the second linkage portion 136 can be preferably stacked with each other (but not limited thereto, meaning that the present invention can adopt other linkage design, such as the shaft-hole fitting design). Furthermore, in this embodiment, the first connection portion 126 and the third connection portion 132 can preferably protrude from the first support member 118 and the second support member 120 respectively, and a first containing slot 138 and a second containing slot 140 are formed on the cap 102 corresponding to the first connection portion 126 and the third connection portion 132 respectively. The first connection portion 126 of the first support member 118 is movably inserted into the first containing slot 138, and the third connection portion 132 of the second support member 120 is movably inserted into the second containing slot 140. Via the aforesaid connection design, the present invention can ensure that the first support member 118 and the second support member 120 can move together when the cap 102 is pressed by the external force or the external force is released.

Furthermore, as shown in FIG. 2, the keyswitch 100 can further include a circuit board 142. The circuit board 142 can be a membrane circuit board, a flexible circuit board, or a printed circuit board. The circuit board 142 can have a switch 143 (e.g. a membrane switch or other triggering switch) corresponding to a triggering structure 119 (preferably a bending triggering member extending toward the circuit board 142 as shown in FIG. 2, but not limited thereto) of the first support member 118 and a triggering structure 121 (preferably a bending triggering member extending toward the circuit board 142 as shown in FIG. 2, but not limited thereto) of the second support member 120. Accordingly, when the cap 102 of the keyswitch 100 is pressed to the pressed position, the triggering structure 119 of the first support member 118 and the triggering structure 121 of the second support member 120 can trigger the switch 135 on the circuit board 134 for performing a corresponding input function.

Figure 4:
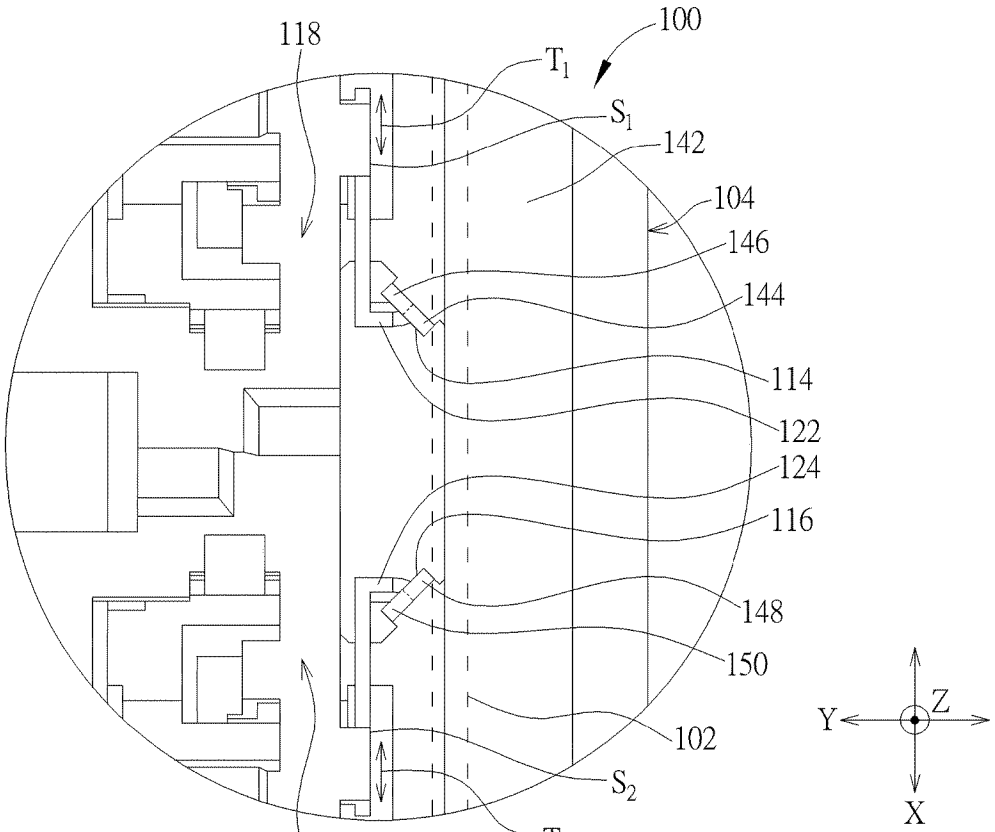
FIG. 4 is a partial enlarged diagram of the keyswitch in FIG. 2.
Figure 5:
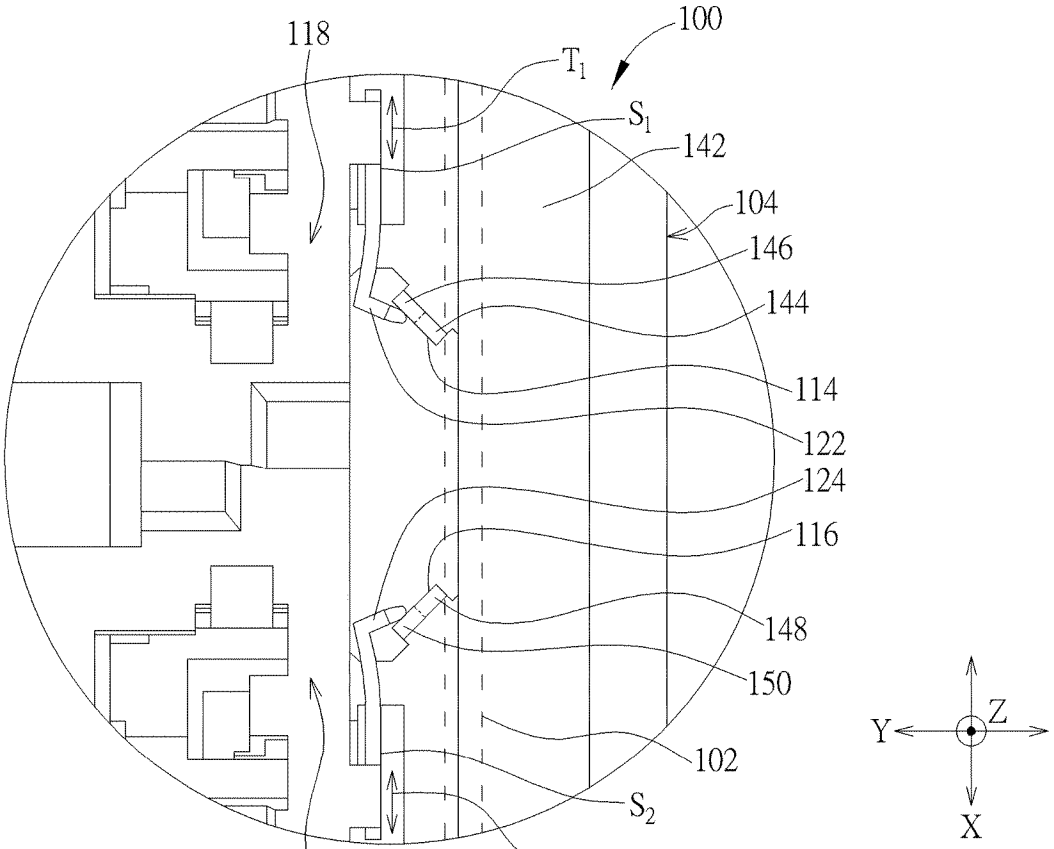
FIG. 5 is a partial enlarged top view of the cap in FIG. 2 being pressed to a pressed position.

Please refer to FIG. 2, FIG. 4, and FIG. 5. FIG. 4 is a partial enlarged diagram of the keyswitch 100 in FIG. 2. FIG. 5 is a partial enlarged top view of the cap 102 in FIG. 2 being pressed to the pressed position. As shown in FIG. 2, FIG. 4, and FIG. 5, when the cap 102 is not pressed, the first hook structure 122 abuts against the first abutting surface 114 and the second hook structure 124 abuts against the second abutting surface 116 to keep the cap 102 at the non-pressed position as shown in FIG. 2. When the cap 102 is pressed by the external force, the first hook structure 122 can slide on the first abutting surface 114 to increase an amount of elastic deformation of the first hook structure 122 (as shown in FIG. 5), and the second hook structure 124 can slide on the second abutting surface 116 to increase an amount of elastic deformation of the second hook structure 124 (as shown in FIG. 5). During the aforesaid process, with rotation of the first support member 118 and the second support member 120, the cap 102 can move downward from the non-pressed position as shown in FIG. 2 to the pressed position as shown in FIG. 5 to trigger the switch 143 of the circuit board 142 via the triggering structure 119 and the triggering structure 121 for performing a corresponding input function. When the external force is released, the deformed first hook structure 122 can provide a first elastic force to drive the first support member 118 to slide and the deformed second hook structure 122 can provide a second elastic force to drive the second support member 120 to slide to make the cap 102 move back to the non-pressed position as shown in FIG. 2 via linkage of the first linkage portion 130 and the second linkage portion 136 for generating the automatic cap returning effect.

To be more specific, as shown in FIG. 4 and FIG. 5, in this embodiment, the first hook structure 122 can be formed on a first side $S_1$ of the first support member 118 and the second hook structure 124 can be formed on a second side $S_2$ of the second support member 120. The first side $S_1$ of the first support member 118 can move along a first movement path $T_1$ parallel to the X-axis, and the second side $S_2$ of the second support member 120 can move along a second movement path $T_2$ parallel to the X-axis. The first abutting surface 114 can have a first relatively far region 144 and a first relatively close region 146, and the second abutting surface 116 can have a second relatively far region 148 and a second relatively close region 150. A distance between the first relatively close region 146 and the first movement path $T_1$ is less than a distance between the first relatively far region 144 and the first movement path $T_1$, and a distance between the second relatively close region 150 and the second movement path $T_2$ is less than a distance between the second relatively far region 148 and the second movement path $T_2$.

Via the aforesaid design, when the cap 102 is not pressed, the first hook structure 122 abuts against the first relatively far region 144 and the second hook structure 124 abuts against the second relatively far region 148, to keep the cap 102 at the non-pressed position as shown in FIG. 2. When the cap 102 is pressed by the external force, the first hook structure 122 can slide to the first relatively close region 146 along the first abutting surface 114 to increase the amount of elastic deformation of the first hook structure 122 (as shown in FIG. 5), and the second hook structure 124 can slide to the second close relatively region 150 along the second abutting surface 116 to increase the amount of elastic deformation of the second hook structure 124 (as shown in FIG. 5). During the aforesaid process, with rotation of the first support member 118 and the second support member 120, the cap 102 can move downward from the non-pressed position as shown in FIG. 2 to the pressed position as shown in FIG. 5 to trigger the switch 143 of the circuit board 142 via the triggering structure 119 and the triggering structure 121 for performing a corresponding input function. When the external force is released, the deformed first hook structure 122 can provide the first elastic force to drive the first support member 118 to slide for making the first hook structure 122 move back to abut against the first relatively far region 144, and the deformed second hook structure 122 can provide the second elastic force to drive the second support member 120 to slide for making the second hook structure 124 move back to abut against the second relatively far region 148. Accordingly, the cap 102 can move back to the non-pressed position as shown in FIG. 2 via linkage of the first linkage portion 130 and the second linkage portion 136 for generating the automatic cap returning effect.

To be noted, the present invention can adopt the design that the bending member deforms outwardly relative to the support member in another embodiment, for improving flexibility of the keyswitch in the cap returning design. In brief, in another embodiment, when the cap is pressed from the non-pressed position to the pressed position, the first elastic hook arm of the first support member slides along the first abutting surface of the board to make the first bending member deform outwardly relative to the first support member, and the second elastic hook arm of the second support member slides along the second abutting surface of the board to make the second bending member deform outwardly relative to the second support member. On the other hand, when the external force is released, the deformed first bending member and the deformed second bending member can provide a first elastic force and a second elastic force respectively to drive the first support member and the second support member to slide relatively to make the cap move back to the non-pressed position for generating the automatic cap returning effect. As for other related description for this embodiment, it can be reasoned by analogy according to the aforesaid embodiment and omitted herein.

Figure 6:
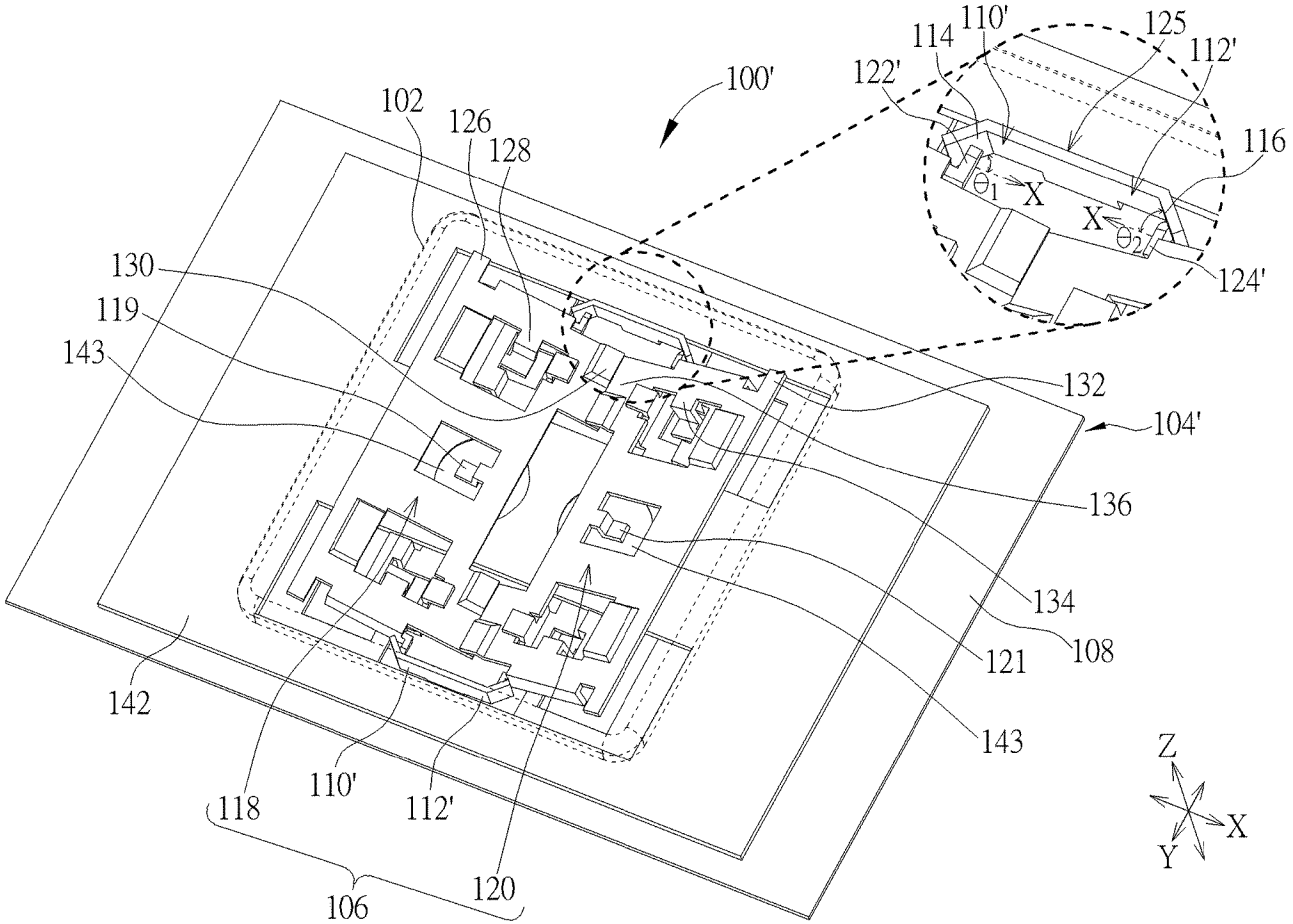
FIG. 6 is an enlarged diagram of a keyswitch according to another embodiment of the present invention.
Figure 7:
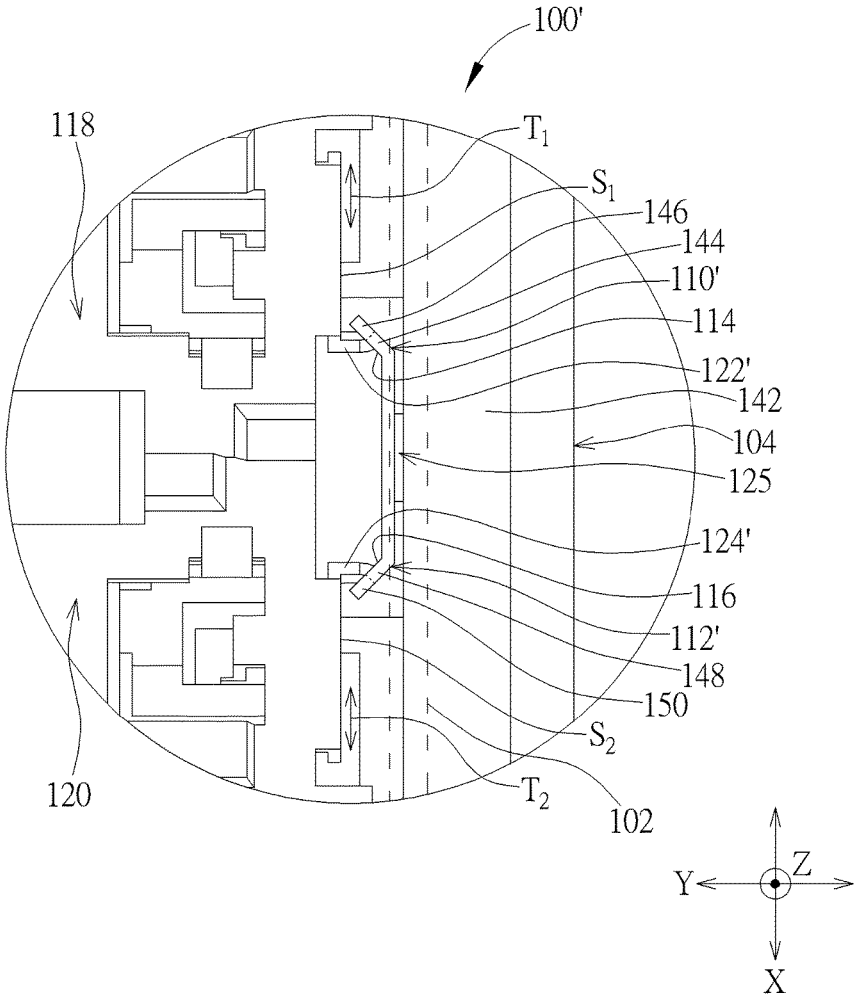
FIG. 7 is a partial enlarged top view of the keyswitch in FIG. 6.
Figure 8:
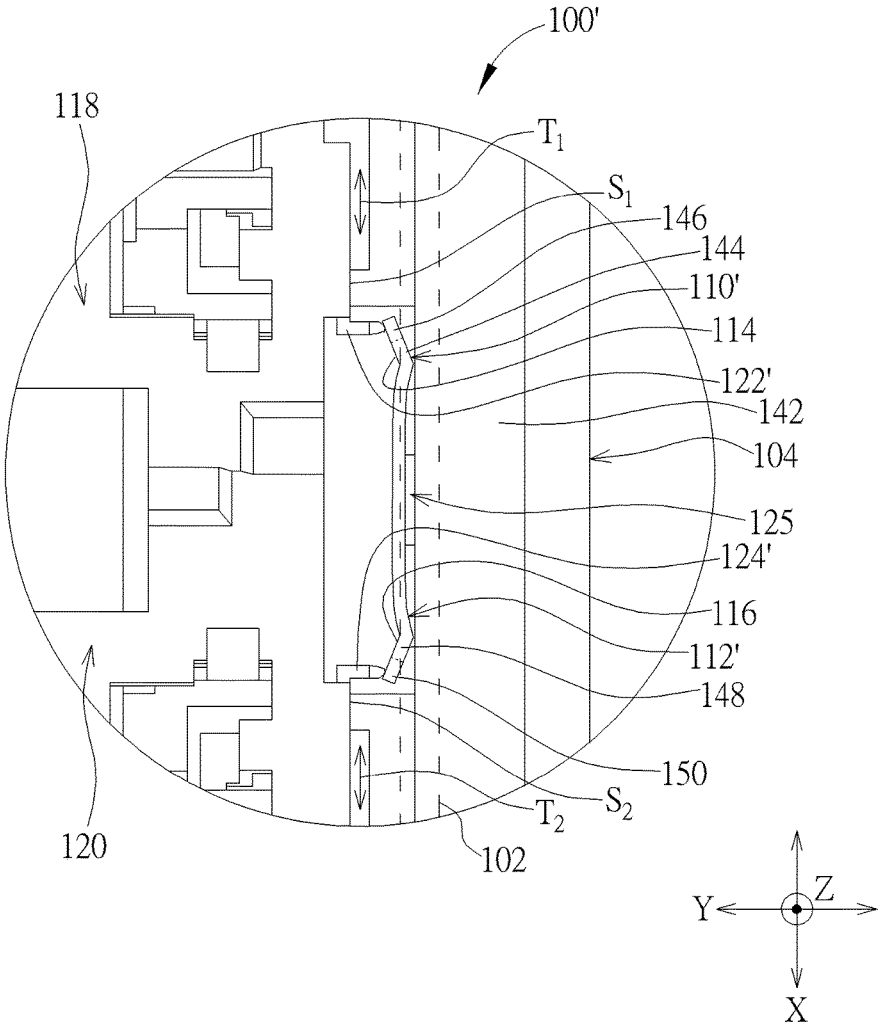
FIG. 8 is a partial enlarged diagram of a cap in FIG. 6 being pressed to a pressed position.

Furthermore, the structural design of the bending member on the board is not limited to the aforesaid embodiment. For example, please refer to FIG. 6, FIG. 7, and FIG. 8. FIG. 6 is an enlarged diagram of a keyswitch 100' according to another embodiment of the present invention. FIG. 7 is a partial enlarged top view of the keyswitch 100' in FIG. 6. FIG. 8 is a partial enlarged diagram of the cap 102 in FIG. 6 being pressed to the pressed position. Components both mentioned in this embodiment and the aforesaid embodiment represent components with similar structures or functions, and the related description is omitted herein. As shown in FIG. 6, FIG. 7, and FIG. 8, the keyswitch 100' includes the cap 102, a board 104', and the support device 106. The cap 102 is disposed above the board 104'. The board 104' has the main body 108, at least one first bending member 110' (two shown in FIG. 6, but not limited thereto), and at least one second bending member 112' (two shown in FIG. 6, but not limited thereto). The first bending member 110' has the first abutting surface 114. The second bending member 112' has the second abutting surface 116. The support device 106 is disposed between the cap 102 and the board 104'. The support device 106 includes the first support member 118 and the second support member 120. The first support member 118 and the second support member 120 are movably connected to the cap 102 and the board 104' to make the cap 102 movable between the non-pressed position and the pressed position with rotation of the first support member 118 and the second support member 120. A first hook structure 122' is formed on the first support member 118, and a second hook structure 124' is formed on the second support member 120. In this embodiment, the first hook structure 122' can preferably be a first hook extending from a side of the first support member 118 toward the first bending member 110', and the second hook structure 124' can preferably be a second hook extending from a side of the second support member 120 toward the second bending member 112'. The second bending member 112' can extend from the first bending member 110' toward the second support member 120 to form an elastic sheet structure 125 (preferably a T-shaped structure as shown in FIG. 6, but not limited thereto) cooperatively with the first bending member 110'.

Via the aforesaid design, when the cap 102 is not pressed, the first hook structure 122' abuts against the first abutting surface 114 and the second hook structure 124' abuts against the second abutting surface 116 to keep the cap 102 at the non-pressed position as shown in FIG. 6. When the cap 102 is pressed by the external force, the first hook structure 122' can slide along the first abutting surface 114 to make the first bending member 110' deform outwardly relative to the first support member 118 (as shown in FIG. 8), and the second hook structure 124' can slide along the second abutting surface 116 to make the second bending member 112' deform outwardly relative to the second support member 120 (as shown in FIG. 8). During the aforesaid process, with rotation of the first support member 118 and the second support member 120, the cap 102 can move downward from the non-pressed position as shown in FIG. 6 to the pressed position as shown in FIG. 8 to trigger the switch 143 of the circuit board 142 via the triggering structure 119 and the triggering structure 121 for performing a corresponding input function. When the external force is released, the deformed first bending member 110' and the deformed second bending member 112' can provide the first elastic force and the second elastic force respectively to drive the first support member 118 and the second support member 120 to slide relatively. In such a manner, the cap 102 can move from the pressed position as shown in FIG. 8 back to the non-pressed position as shown in FIG. 6 for generating the automatic cap returning effect.

To be more specific, as shown in FIG. 7 and FIG. 8, in this embodiment, the first hook structure 122' can be formed on the first side $S_1$ of the first support member 118 and the second hook structure 124' can be formed on the second side $S_2$ of the second support member 120. Via the aforesaid design, when the cap 102 is not pressed, the first hook structure 122' abuts against the first relatively far region 144 and the second hook structure 124' abuts against the second relatively far region 148 to keep the cap 102 at the non-pressed position as shown in FIG. 6. When the cap 102 is pressed by the external force, the first hook structure 122' can slide to the first relatively close region 146 along the first abutting surface 114 to make the first bending member 110' deform outwardly relative to the first support member 118, and the second hook structure 124' can slide to the second relatively close region 150 along the second abutting surface 116 to make the second bending member 112' deform outwardly relative to the second support member 120 (as shown in FIG. 8). During the aforesaid process, with rotation of the first support member 118 and the second support member 120, the cap 102 can move downward from the non-pressed position as shown in FIG. 6 to the pressed position as shown in FIG. 8 to trigger the switch 143 of the circuit board 142 via the triggering structure 119 and the triggering structure 121 for performing a corresponding input function. When the external force is released, the deformed first bending member 110' can provide the first elastic force to drive the first support member 118 to slide for making the first hook structure 122' move back to abut against the first relatively far region 144 as shown in FIG. 7, and the deformed second hook structure 124' can provide the second elastic force to drive the second support member 120 to slide for making the second hook structure 124' move back to abut against the second relatively far region 148 as shown in FIG. 7. Accordingly, the cap 102 can move back to the non-pressed position as shown in FIG. 6 via linkage of the first linkage portion 130 and the second linkage portion 136 for generating the automatic cap returning effect.

To be noted, the present invention can adopt the design that the hook deforms inwardly relative to the bending member in another embodiment, for improving flexibility of the keyswitch in the cap returning design. In brief, in another embodiment, when the cap is pressed from the non-pressed position to the pressed position, the first hook structure slides along the first abutting surface of the board to deform inwardly relative to the first support member, and the second hook structure slides along the second abutting surface of the board to deform inwardly relative to the second support member. On the other hand, when the external force is released, the deformed first hook structure and the deformed second hook structure can provide the first elastic force and the second elastic force respectively to drive the first support member and the second support member to slide relatively to make the cap move back to the non-pressed position for generating the automatic cap returning effect. As for other related description for this embodiment, it can be reasoned by analogy according to the aforesaid embodiments and omitted herein.

In summary, compared with the prior art design that the elastic member is disposed between the cap and the board for providing an elastic force, the present invention adopts the design that the hook structure abuts against the bending member obliquely formed on the board to cause elastic deformation of the hook structure or the bending member with sliding of the support member for providing the elastic force to drive the cap to move back to its original position automatically. In such a manner, the present invention can efficiently reduce the overall height of the keyswitch to be advantageous to the thinning design of the keyboard. Furthermore, since there is no need to dispose an elastic member between the cap and the board, the present invention can also extend the life of the keyswitch.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a board having a main body, at least one first bending member, and at least one second bending member, the main body extending along a plane containing an X-axis and a Y-axis, the X-axis and the Y-axis being perpendicular to each other, the at least one first bending member having a first abutting surface, the at least one second bending member having a second abutting surface, an included angle between the X-axis and the first abutting surface being larger than 0°, an included angle between the X-axis and the second abutting surface being larger than 0°;

a cap disposed above the board; and a support device disposed between the board and the cap, the support device comprising a first support member and a second support member, the first support member and the second support member being movably connected to the cap and the board, a first hook structure being formed on the first support member, a second hook structure being formed on the second support member, the first hook structure being a first hook extending from the first support member toward the at least one first bending member, the second hook structure being a second hook extending from the second support member toward the at least one second bending member, the at least one second bending member extending from the at least one first bending member toward the second support member to form an elastic sheet structure cooperatively with the at least one first bending member;

wherein when the cap is not pressed, the first hook structure abuts against the first abutting surface and the second hook structure abuts against the second abutting surface to keep the cap at a non-pressed position;

when the cap is pressed by an external force, the first hook structure slides on the first abutting surface to increase an amount of elastic deformation of at least one of the first hook structure and the at least one first bending member, and the second hook structure slides on the second abutting surface to increase an amount of elastic deformation of at least one of the second hook structure and the at least one second bending member;

when the external force is released, the at least one of the first hook structure and the at least one first bending member provides a first elastic force to drive the first support member to slide, and the at least one of the second hook structure and the at least one second bending member provides a second elastic force to drive the second support member to slide to make the cap move back to the non-pressed position.

2. The keyswitch of claim 1, wherein the first hook slides along the first abutting surface to make the at least one first bending member deform outwardly relative to the first support member and the second hook slides along the second abutting surface to make the at least one second bending member deform outwardly relative to the second support member when the cap moves from the non-pressed position to a pressed position, and the at least one first bending member and the at least one second bending member provide the first elastic force and the second elastic force respectively to drive the first support member and the second support member to slide relatively when the external force is released to make the cap move from the pressed position back to the non-pressed position.

3. The keyswitch of claim 1, wherein the first hook slides along the first abutting surface to deform inwardly relative to the first support member and the second hook slides along the second abutting surface to deform outwardly relative to the second support member when the cap moves from the non-pressed position to a pressed position, and the deformed first hook and the deformed second hook provide the first elastic force and the second elastic force respectively to drive the first support member and the second support member to slide relatively when the external force is released to make the cap move from the pressed position back to the non-pressed position.

4. The keyswitch of claim 1, wherein the first support member has a first connection portion, a second connection portion, and a first linkage portion, the second support member has a third connection portion, a fourth connection portion, and a second linkage portion, the first connection portion and the third connection portion are movably connected to the cap and the second connection portion and the fourth connection portion are movably connected to the board to make the cap movable upward and downward relative to the board, and the first linkage portion and the second linkage portion are movably joined with each other to make the first support member and the second support member move together when the cap is pressed or the external force is released.

5. The keyswitch of claim 4, wherein the first linkage portion and the second linkage portion are stacked with each other.

6. The keyswitch of claim 4, wherein the first connection portion protrudes from the first support member, a first containing slot is formed on the cap corresponding to the first connection portion, the third connection portion protrudes from the second support member, a second containing slot is formed on the cap corresponding to the third connection portion, and the first connection portion is movably inserted into the first containing slot and the third connection portion is movably inserted into the second containing slot, to make the first support member and the second support member move together when the cap is pressed or the external force is released.

7. A keyswitch comprising:

a board having a main body, at least one first bending member, and at least one second bending member, the main body extending along a plane containing an X-axis and a Y-axis, the X-axis and the Y-axis being perpendicular to each other, the at least one first bending member having a first abutting surface, the at least one second bending member having a second abutting surface, an included angle between the X-axis and the first abutting surface being larger than 0°, an included angle between the X-axis and the second abutting surface being larger than 0°;

a cap disposed above the board; and a support device disposed between the board and the cap, the support device comprising a first support member and a second support member, the first support member and the second support member being movably connected to the cap and the board, a first hook structure being formed at a first side of the first support member, a second hook structure being formed on a second side of the second support member, the first hook structure being a first hook extending from the first support member toward the at least one first bending member, the second hook structure being a second hook extending from the second support member toward the at least one second bending member, the at least one second bending member extending from the at least one first bending member toward the second support member to form an elastic sheet structure cooperatively with the at least one first bending member, the first side of the first support member being movable along a first movement path relative to the board, the second side of the second support member being movable along a second movement path relative to the board, the first movement path and the second movement path being parallel to the X-axis, the first abutting surface having a first relatively far region and a first relatively close region, a distance between the first relatively close region and the first movement path being less than a distance between the first relatively far region and the first movement path, the second abutting surface having a second relatively far region and a second relatively close region, and a distance between the second relatively close region and the second movement path being less than a distance between the second relatively far region and the second movement path;

wherein when the cap is not pressed, the first hook structure abuts against the first relatively far region and the second hook structure abuts against the second relatively far region to keep the cap at a non-pressed position;

when the cap is pressed by an external force, the first hook structure slides to the first relatively close region along the first abutting surface to increase an amount of elastic deformation of at least one of the first hook structure and the at least one first bending member, and the second hook structure slides to the second relatively close region along the second abutting surface to increase an amount of elastic deformation of at least one of the second hook structure and the at least one second bending member;

when the external force is released, the at least one of the first hook structure and the at least one first bending member provides a first elastic force to drive the first support member to slide for making the first hook structure move back to abut against the first relatively far region, and the at least one of the second hook structure and the at least one second bending member provides a second elastic force to drive the second support member to slide for making the second hook structure move back to abut against the second relatively far region to make the cap move back to the non-pressed position.

8. The keyswitch of claim 7, wherein the first hook slides from the first relatively far region to the first relatively close region along the first abutting surface to make the at least one first bending member deform outwardly relative to the first support member and the second hook slides from the second relatively far region to the second relatively close region along the second abutting surface to make the at least one second bending member deform outwardly relative to the second support member when the cap moves from the non-pressed position to a pressed position, and the at least one first bending member and the at least one second bending member provide the first elastic force and the second elastic force respectively to drive the first support member and the second support member to slide relatively when the external force is released to make the cap move from the pressed position back to the non-pressed position.

9. The keyswitch of claim 7, wherein the first hook slides from the first relatively far region to the first relatively close region along the first abutting surface to deform inwardly relative to the first support member and the second hook slides from the second relatively far region to the second relatively close region along the second abutting surface to deform outwardly relative to the second support member when the cap moves from the non-pressed position to a pressed position, and the deformed first hook and the deformed second hook provide the first elastic force and the second elastic force respectively to drive the first support member and the second support member to slide relatively when the external force is released to make the cap move from the pressed position back to the non-pressed position.

10. The keyswitch of claim 7, wherein the first support member has a first connection portion, a second connection portion, and a first linkage portion, the second support member has a third connection portion, a fourth connection portion, and a second linkage portion, the first connection portion and the third connection portion are movably connected to the cap and the second connection portion and the fourth connection portion are movably connected to the board to make the cap movable upward and downward relative to the board, and the first linkage portion and the second linkage portion are movably joined with each other to make the first support member and the second support member move together when the cap is pressed or the external force is released.

11. The keyswitch of claim 10, wherein the first linkage portion and the second linkage portion are stacked with each other.

12. The keyswitch of claim 10, wherein the first connection portion protrudes from the first support member, a first containing slot is formed on the cap corresponding to the first connection portion, the third connection portion protrudes from the second support member, a second containing slot is formed on the cap corresponding to the third connection portion, and the first connection portion is movably inserted into the first containing slot and the third connection portion is movably inserted into the second containing slot to make the first support member and the second support member move together when the cap is pressed or the external force is released.

13. A keyswitch comprising:

a board having a main body, at least one first bending member, and at least one second bending member, the main body extending along a plane containing an X-axis and a Y-axis, the X-axis and the Y-axis being perpendicular to each other, the at least one first bending member having a first abutting surface, the at least one second bending member having a second abutting surface, an included angle between the X-axis and the first abutting surface being larger than 0°, an included angle between the X-axis and the second abutting surface being larger than 0°;

a cap disposed above the board; and a support device disposed between the board and the cap, the support device comprising a first support member and a second support member, a first hook structure being formed on the first support member, a second hook structure being formed on the second support member, the first support member having a first connection portion, a second connection portion, and a first linkage portion, the second support member having a third connection portion, a fourth connection portion, and a second linkage portion, the first connection portion and the third connection portion being movably connected to the cap and the second connection portion and the fourth connection portion being movably connected to the board to make the cap movable upward and downward relative to the board, and the first linkage portion and the second linkage portion being stacked with each other to make the first support member and the second support member move together when the cap is pressed by an external force or the external force is released;

wherein when the cap is not pressed, the first hook structure abuts against the first abutting surface and the second hook structure abuts against the second abutting surface to keep the cap at a non-pressed position;

when the cap is pressed by the external force, the first hook structure slides on the first abutting surface to increase an amount of elastic deformation of at least one of the first hook structure and the at least one first bending member, and the second hook structure slides on the second abutting surface to increase an amount of elastic deformation of at least one of the second hook structure and the at least one second bending member;

when the external force is released, the at least one of the first hook structure and the at least one first bending member provides a first elastic force to drive the first support member to slide, and the at least one of the second hook structure and the at least one second bending member provides a second elastic force to drive the second support member to slide to make the cap move back to the non-pressed position.

14. The keyswitch of claim 13, wherein the first connection portion protrudes from the first support member, a first containing slot is formed on the cap corresponding to the first connection portion, the third connection portion protrudes from the second support member, a second containing slot is formed on the cap corresponding to the third connection portion, and the first connection portion is movably inserted into the first containing slot and the third connection portion is movably inserted into the second containing slot, to make the first support member and the second support member move together when the cap is pressed or the external force is released.

15. A keyswitch comprising:

a board having a main body, at least one first bending member, and at least one second bending member, the main body extending along a plane containing an X-axis and a Y-axis, the X-axis and the Y-axis being perpendicular to each other, the at least one first bending member having a first abutting surface, the at least one second bending member having a second abutting surface, an included angle between the X-axis and the first abutting surface being larger than 0°, an included angle between the X-axis and the second abutting surface being larger than 0°;

a cap disposed above the board; and a support device disposed between the board and the cap, the support device comprising a first support member and a second support member, a first hook structure being formed at a first side of the first support member, a second hook structure being formed on a second side of the second support member, the first support member having a first connection portion, a second connection portion, and a first linkage portion, the second support member having a third connection portion, a fourth connection portion, and a second linkage portion, the first connection portion and the third connection portion being movably connected to the cap and the second connection portion and the fourth connection portion being movably connected to the board to make the cap movable upward and downward relative to the board, the first linkage portion and the second linkage portion being stacked with each other to make the first support member and the second support member move together when the cap is pressed by an external force or the external force is released, the first side of the first support member being movable along a first movement path relative to the board, the second side of the second support member being movable along a second movement path relative to the board, the first movement path and the second movement path being parallel to the X-axis, the first abutting surface having a first relatively far region and a first relatively close region, a distance between the first relatively close region and the first movement path being less than a distance between the first relatively far region and the first movement path, the second abutting surface having a second relatively far region and a second relatively close region, and a distance between the second relatively close region and the second movement path being less than a distance between the second relatively far region and the second movement path;

wherein when the cap is not pressed, the first hook structure abuts against the first relatively far region and the second hook structure abuts against the second relatively far region to keep the cap at a non-pressed position;

when the cap is pressed by the external force, the first hook structure slides to the first relatively close region along the first abutting surface to increase an amount of elastic deformation of at least one of the first hook structure and the at least one first bending member, and the second hook structure slides to the second relatively close region along the second abutting surface to increase an amount of elastic deformation of at least one of the second hook structure and the at least one second bending member;

when the external force is released, the at least one of the first hook structure and the at least one first bending member provides a first elastic force to drive the first support member to slide for making the first hook structure move back to abut against the first relatively far region, and the at least one of the second hook structure and the at least one second bending member provides a second elastic force to drive the second support member to slide for making the second hook structure move back to abut against the second relatively far region to make the cap move back to the non-pressed position.

16. The keyswitch of claim 15, wherein the first connection portion protrudes from the first support member, a first containing slot is formed on the cap corresponding to the first connection portion, the third connection portion protrudes from the second support member, a second containing slot is formed on the cap corresponding to the third connection portion, and the first connection portion is movably inserted into the first containing slot and the third connection portion is movably inserted into the second containing slot to make the first support member and the second support member move together when the cap is pressed or the external force is released.

* * * * *